US005568678A

United States Patent [19]

Fehrer

[11] Patent Number: 5,568,678

[45] Date of Patent: Oct. 29, 1996

[54] APPARATUS FOR NEEDLING A NONWOVEN WEB ALONG A CIRCULAR PATH

[76] Inventor: Ernst Fehrer, Auf der Gugl 28, A-4020 Linz, Austria

[21] Appl. No.: 456,931

[22] Filed: Jun. 1, 1995

[30] Foreign Application Priority Data

Jun. 27, 1994 [AT] Austria ..... 1261/94

[51] Int. Cl.[6] ..... D04H 18/00

[52] U.S. Cl. ..... 28/115; 28/107

[58] Field of Search ..... 28/107, 111, 113, 28/114, 115; 112/804, 80.42, 80.45, 271

[56] References Cited

U.S. PATENT DOCUMENTS 3,116,534 1/1964 O'Bryne ..... 28/107

FOREIGN PATENT DOCUMENTS 249392 9/1966 Austria .

263395 7/1968 Austria ..... 28/107

1435772 11/1968 Germany ..... 28/107

2000617 7/1971 Germany ..... 28/107

*Primary Examiner*—C. D. Crowder

*Assistant Examiner*—Larry D. Worrell, Jr.

*Attorney, Agent, or Firm*—Collard & Roe, P.C.

[57] ABSTRACT

The described apparatus for needling a nonwoven web comprises a slider-crank mechanism, which is connected to a rocker and serves to actuate at least one needle board, which is secured to the rocker, and web-guiding means comprising a web support, which is opposite to the needle board, and a stripper, which extends between the web support and the needle board. To provide a high needle density it is proposed that the needle board is arranged to extend at right angles to the direction of the mean inclination of the penetration paths of the needles of the needle board when the slider-crank mechanism is in a midstroke position in the middle of its stroke.

2 Claims, 1 Drawing Sheet

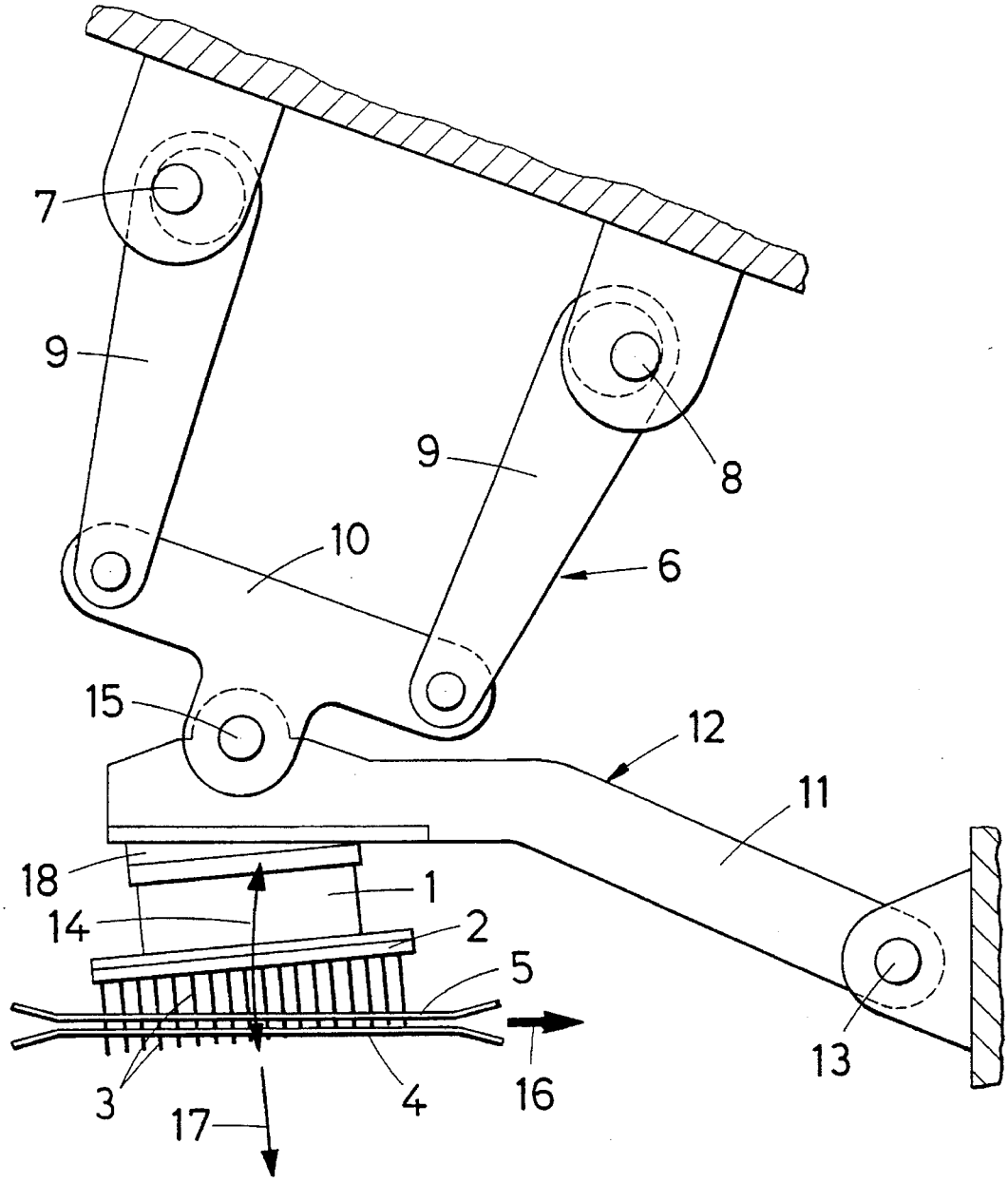
7
9
9
8
10
6
15
12
11
18
1
14
2
5
3
4
16
13
17

APPARATUS FOR NEEDLING A NONWOVEN WEB ALONG A CIRCULAR PATH

BACKGROUND OF THE INVENTION

1. Field of the Invention

This invention relates to an apparatus for needling a nonwoven web, comprising a slider-crank mechanism, which is connected to a rocker and serves to actuate at least one needle board, which is secured to the rocker, and web-guiding means comprising a web support, which is opposite to the needle board, and a stripper, which extends between the web support and the needle board.

2. Description of the Prior Art

Needle boards are actuated by slider-crank mechanisms either by means of push rods, which are slidably mounted in guides, or by means of rockers, which carry the needle boards and to which the slider-crank mechanisms are pivoted (Austrian Patent Specification 249,392). The use of a rocker for guiding the needle boards affords the advantage that the structure is simpler because the need for providing push rods and associated guides between the connecting rods of the slider-crank mechanisms and the needle beam, which carries the needle boards, is eliminated. Besides, the needling operation performed by a needle board which is guided by a rocker will differ from the needling operation performed by a needle board which is reciprocated along a straight line because the conditions for the penetration of the needles are different and this can be utilized for achieving different needling effects. For instance, the mean inclination of the paths along which the needles of the needle board penetrate the nonwoven web relative to the direction of travel of the web can be adjusted, either in that the axis of rotation of the rocker is displaced in the direction in which the needle board is reciprocated or in that the web-guiding means are pivotally moved about a pivotal axis which is disposed adjacent to the middle of the web-guiding means and parallel to the pivotal axis of the rocker. Because the needle boards are usually so arranged that the needles are inclined relative to the mean penetration path, the holes in which the needles pass through the stripper and through the web support must consist of slots so that the needle density is restricted and this may adversely affect the result of the needling operation.

SUMMARY OF THE INVENTION

For this reason it is an object of the invention to provide for needling a nonwoven web an apparatus which is of the kind described first hereinbefore and is so designed that the needle board may have a relatively high density.

The object set forth is accomplished in accordance with the invention in that the needle board is arranged to extend at right angles to the direction of the mean inclination of the penetration paths of the needles of the needle board when the slider-crank mechanism is in a mid-stroke position in the middle of its stroke.

Because the needles of the needle board are at least substantially at right angles to the needle board, an arrangement of the needle board at right angles to the mean penetration paths of the needles will have the result that the needles extend in the direction of the mean penetration path so that the diameters of the holes in which the needles pass through the stripper and through the web support may be minimized and a higher needle density will thus be permitted. Different means may be employed to permit an adjustment of the inclination of the needle board. In the simplest case this may be achieved by the provision of a wedge-shaped shim between the rocker and the needle beam, which carries the needle board.

BRIEF DESCRIPTION OF THE DRAWING

The subject matter of the invention is illustrated by way of example in the drawing, which is a schematic side elevation showing an apparatus in accordance with the invention for needling a nonwoven web.

DETAILED DESCRIPTION OF THE PREFERRED EMBODIMENT

The illustrated apparatus comprises in conventional manner at least one needle board 2, which is held in a needle beam 2 and comprises needles 3, which penetrate a nonwoven web, which is guided between a web support 4 and a stripper 5. To permit the needles to move through the web support 4 and the stripper 4, the parts 4 and 5 consist of perforated plates. The needle board 2 is actuated by a slider-crank mechanism 6, which comprises two parallel crankshafts or eccentric shafts 7, 8, which are driven to rotate in mutually opposite senses, and connecting rods 9, which are rotatably mounted on said crankshafts or eccentric shafts 7, 8. The connecting rods 9 are interconnected by a link 10 in a four-bar linkage and a rocker 12 comprising parallel arms 11 is pivoted to the link 10 in the middle of its length. The pivotal axis of that rocker 12 is designated 13. Because the needle beam 1 is guided by the rocker 12, the slider-crank mechanism 6 reciprocates the needle board 2 up and down along an arc of a circle 14 about the pivotal axis 13. The motion of the rocker about the pivotal axis 13 is compensated by a wobbling motion of the link about the axis 15 on which the link is pivoted to the rocker 12.

To achieve a first-order mass balance, the slider-crank mechanism is so inclined that the horizontal components of force which are due to the guidance of the needle board 2 along an arc of a circle by the rocker 5 are properly taken into account.

Because the paths on which needles 3 penetrate the nonwoven web extend along arcs of circles, the penetration paths of the needles 3 have a mean inclination relative to the direction of travel 16 of the nonwoven web. That inclination of the penetration paths might require the holes in the stripper 5 and in the web support 4 to be so large in diameter that the needle density is so restricted that the result of the needling operation is adversely affected. This is avoided in that the arrangement is such that when the slider-crank mechanism 6 and the needle board 2 is in a mid-position at the middle of its stroke the needles 3 extend in the direction 17 of the mean inclination of the penetration paths. To that end the needle board 2 is at right angles to the direction 17 of that mean inclination because a wedge-shaped shim 18 is provided between the rocker 12 and the needle beam 1. As a result, the holes in which the needles move through the stripper 5 and through the web support 4 will be required to be only slightly larger in diameter than in strippers and web supports associated with needle boards guided along straight lines, provided that said holes have been drilled at a suitable inclination,

I claim:

1. An apparatus for needling a nonwoven web as it moves in a direction of travel, which comprises (a) a needle board carrying needles, (b) web-guiding means adapted to guide the nonwoven web in the direction of travel, the web guiding means comprising (1) a web support facing the needle board and (2) a stripper extending between the web support and the needle board, (c) a rocker pivotal about an axis, (1) the needle board being secured to the rocker, (d) a slider-crank mechanism, the rocker being linked to the mechanism and being reciprocable about the axis by the mechanism through a stroke having a mid-point whereby the needle board and needles move along a circular path centered on the axis during reciprocation, and the needles are caused to penetrate the nonwoven web between the web support and stripper along circular penetration paths having a predetermined mean inclination relative to the direction of travel, and (e) means for positioning the needle board relative to the rocker so that the needle board extends perpendicularly to the mean inclination of the penetration paths at the midposition of the stroke.

2. The apparatus of claim 1, wherein the positioning means is a wedge-shaped shim between the rocker and the needle board.

* * * * *